US007297025B2

(12) United States Patent
Wei

(10) Patent No.: US 7,297,025 B2
(45) Date of Patent: Nov. 20, 2007

(54) ELECTRICAL CONNECTOR

(75) Inventor: Kuan-Yang Wei, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/434,769

(22) Filed: May 17, 2006

(65) Prior Publication Data

US 2006/0292929 A1 Dec. 28, 2006

(30) Foreign Application Priority Data

Jun. 22, 2005 (TW) ..... 94210471 U
Jun. 29, 2005 (TW) ..... 94210916 U

(51) Int. Cl.
*H01R 13/648* (2006.01)

(52) U.S. Cl. ..... 439/607; 439/108; 439/95

(58) Field of Classification Search ..... 439/607–608, 439/95, 108

See application file for complete search history.

(56) References Cited

U.S. PATENT DOCUMENTS 5,104,326 A * 4/1992 Smith et al. ..... 439/95
6,685,509 B1 * 2/2004 Yeh ..... 439/607
6,709,286 B1 * 3/2004 Korsunsky et al. ..... 439/557
6,786,770 B1 * 9/2004 Huang ..... 439/607
6,948,980 B2 * 9/2005 Xiang et al. ..... 439/607

* cited by examiner

*Primary Examiner*—Truc Nguyen
(74) *Attorney, Agent, or Firm*—Rosenberg, Klein & Lee

(57) ABSTRACT

An electrical connector includes an insulative housing, a plurality of terminals, a holding member and a shielding covering having a latch element, wherein the holding member including a plurality of resilient plates, a coupling portion for coupling the resilient plates, and a pair of extending portions. In assembly, the holding member is inserted into the insulative housing in a direction of the rear face of the insulative housing and therefore the extending portion adheres to the rear face, then the shielding covers the insulative housing in a direction of the front face of the insulative housing and therefore the latch element is inserted through the slot and interferentially contacting the extending portion of the holding member.

5 Claims, 9 Drawing Sheets

ELECTRICAL CONNECTOR

BACKGROUND OF THE INVENTION

1. Field of the Invention

The present invention relates to an electrical connector, and particularly to a thin electrical connector adapted to LVDS (Low Voltage Differential Signal) displaying interface.

2. Related Art

A thin receptacle connector has been widely used in the filed of panel products in recent years; such thin receptacle connector generally is referred to LVDS (Low Voltage Differential Signal) connector as well and is made in miniaturized structure. The LVDS connector is soldered to a printed circuit board (PCB) and mates with a flexible printed circuit board (FPCB) for electrically communication. Because of the miniaturized structure and concerning about a linking strength between each part of the connector, a configuration of the LVDS connector would have been restricted, especially the configuration of a metal shell, terminals, and grounding parts. Generally, the metal shell covers an insulative body of the connector for increasing the strength of the insulative body, and the grounding parts can further connect to the metal shell for ridding influences of electromagnetic interference (EMI) and static interference. Such connector with improved structure for preventing EMI and static interference is disclosed, for instance, in TW utility model application No. 092123863 as illustrated in FIG. 1. The connector includes a grounding part 11, an insulative housing 12 and a casing 13, wherein the insulative part 11 has a contact portion 111 extending from a side thereof. In assembly, the contact portion 111 is inserted into a gape 121 of the insulative body 12 in an opposite direction of the casing 13, and therefore the contact portion 111 upwardly contact against an inner side of a sidewall 131 of the casing 13, whereby an electrical communication is formed between the casing 13 and the grounding part 11. The connector is grounded by connecting a grounding terminal 112 attached to the grounding part 11 and the PCB (not shown).

However, considerable problems often are encountered because the contact portion 111 is a cantilever structure, which often causes the contact portion 111 improperly contacting the sidewall 131 of the casing 13 because of a resilient angle. That is, if the resilient angle of the contact portion 111 is too small, the contact portion 111 may fails to contact the sidewall 131, whereas if the resilient angle is too big, the contact portion 111 may be against lateral sides of the casing 13 and may cause damage to the grounding part 11. Moreover, the grounding part 11 further has a clipping board 123 for engaging with the insulative body 12. Obviously, the conventional electrical connector has too many components, which is not advantageous to assembly and fabrication.

SUMMARY OF THE INVENTION

Accordingly, an object of the present invention is to provide an electrical connector which can be assembled easily and firmly.

Another object of the present invention is to provide an electrical connector which has structure to remove EMI and static interference.

Another object of the present invention is to provide an electrical connector which has simple structure.

To achieve the above-mentioned objects, an electrical connector in accordance with the present invention include an insulative housing, a plurality of terminals, a holding member and a shielding covering having a latch element, wherein the holding member including a plurality of resilient plates, a coupling portion for coupling the resilient plates, and a pair of extending portions. In assembly, the holding member is inserted into the insulative housing in a direction of the rear face of the insulative housing and therefore the extending portion adheres to the rear face, then the shielding covers the insulative housing in a direction of the front face of the insulatiave housing and therefore the latch element is inserted through the slot and interferentially contacting the extending portion of the holding member.

DESCRIPTION OF THE PREFERRED EMBODIMENTS

Figure 1:
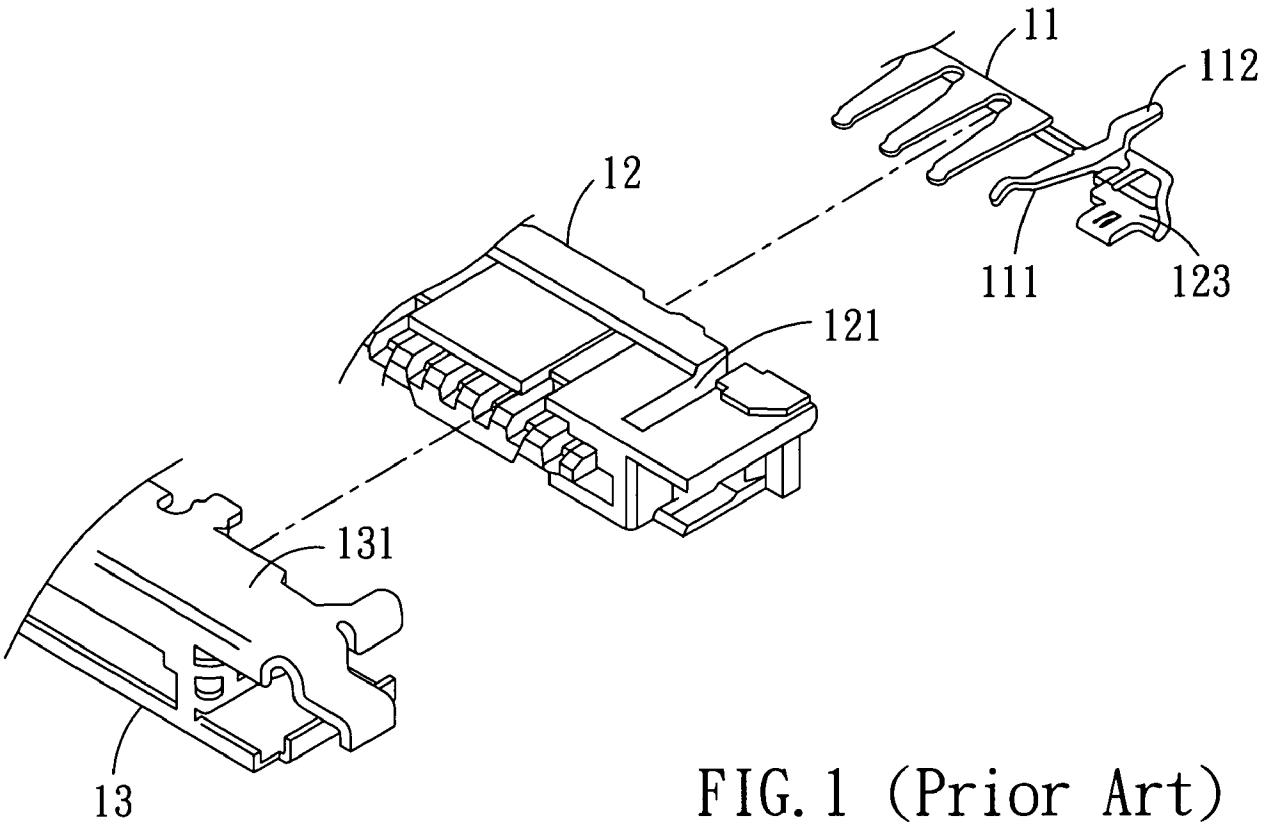
FIG. 1 (Prior Art)
FIG. 1 is a schematic view showing a conventional thin connector.
Figure 2:
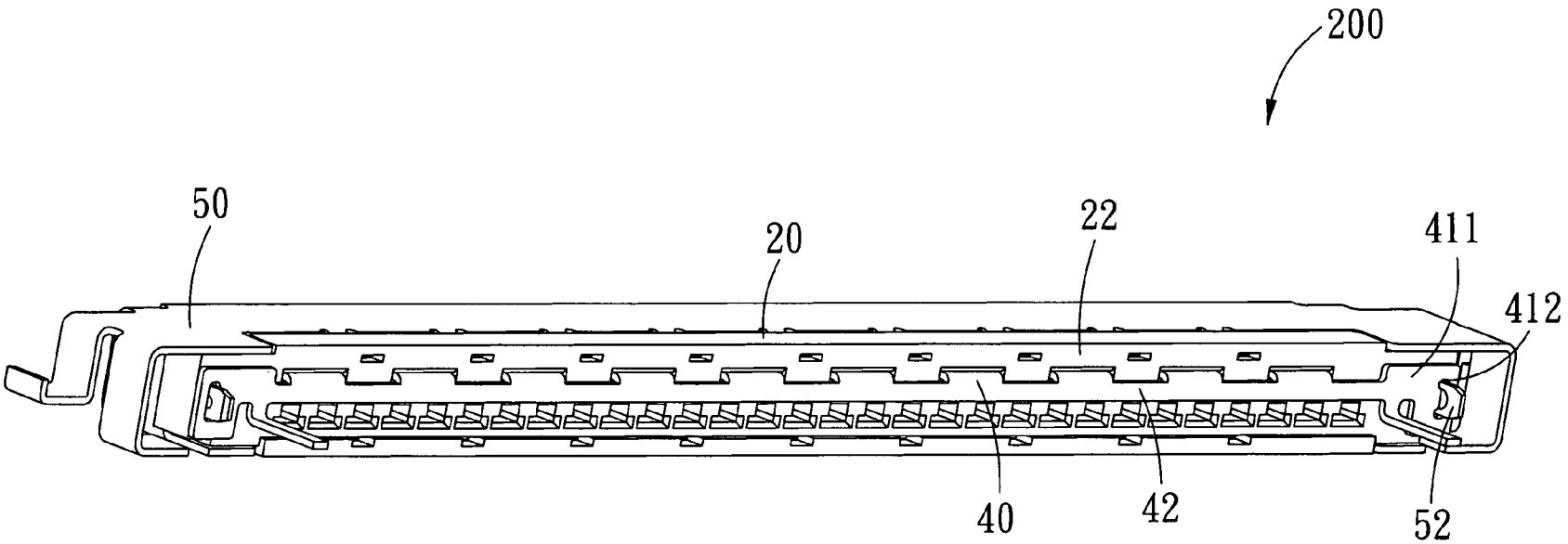
FIG. 2 is a rear perspective view of an electrical connector according to the first embodiment of the present invention.
Figure 3:
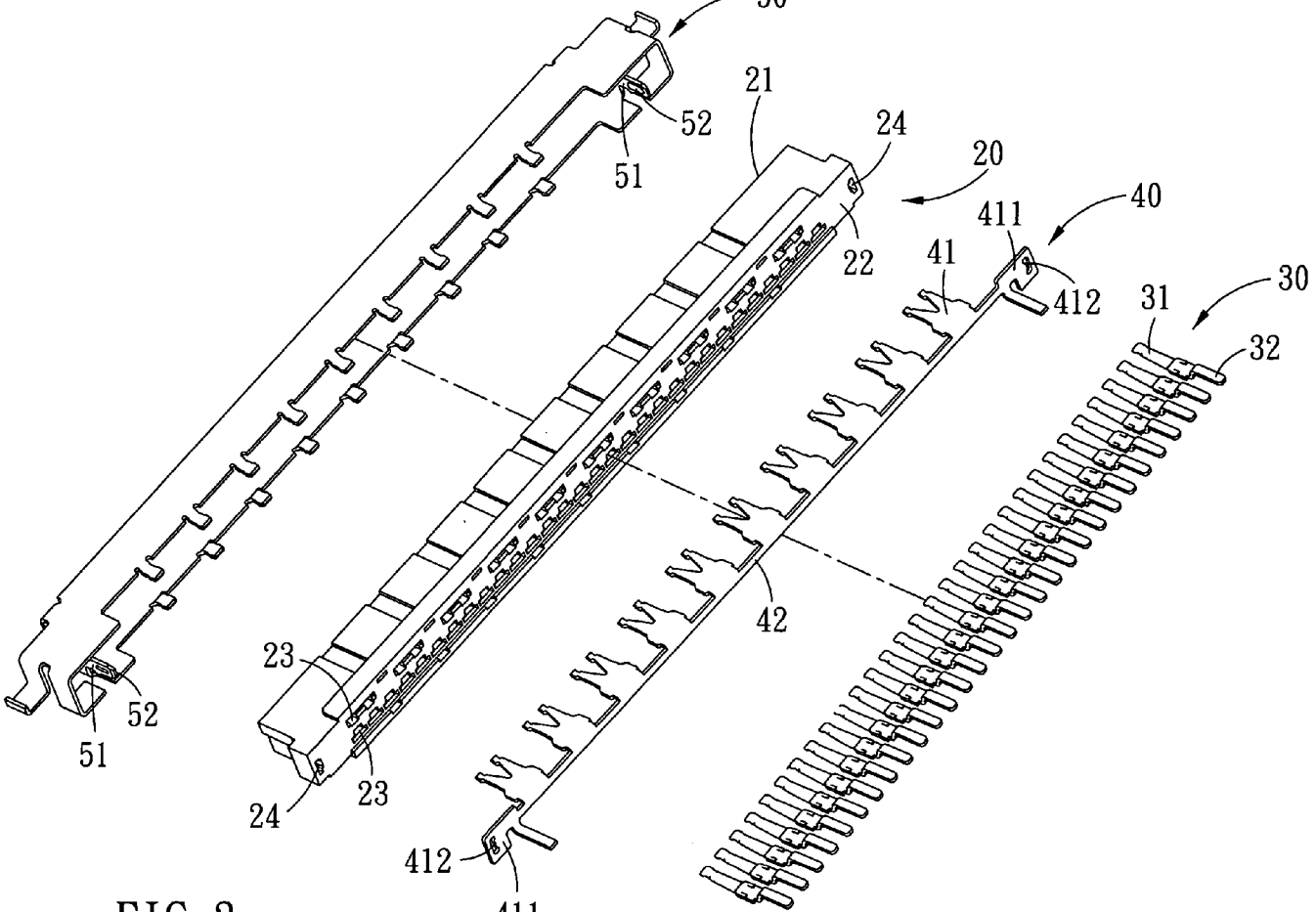
FIG. 3 is an exploded view of FIG. 2.

Referring to FIGS. 2 and 3, the first embodiment of an electrical connector 200 of the present invention includes an insulative housing 20, a plurality of terminals 30, a holding member 40 and a shielding 50. The insulative housing of rectangle-shaped has a front face 21 for connecting with a mating connector (not shown), and a rear face 22 having a plurality of terminal passageways 23 for receiving the plurality of terminals 30. The rear face 22 further has a pair of slots 24 disposed at opposite ends thereof, the slots 24 extending inwardly from the rear face 22 and through the front face 21. Each terminal 30 has a contact part 31 and a soldering part 32, wherein the contact part 31 extends forward toward the front face 21, and the soldering part 32 extends out of the insulative housing 20.

The holding member 40 includes a plurality of resilient plates 41, a coupling portion 42 for coupling the resilient plates 41, and a pair of extending portions 411 extending outwardly from opposite ends of the coupling portion 42, each extending portion 411 having a hole 412. The resilient plates 41 are respectively inserted into the terminal passageways 23 of the insulative housing 20, and therefore the coupling portion 42 and the extending portions 411 completely adhere to the rear face 22 of the insulative housing 20, and the holes 412 are in alignment with the slots 24.

The shielding 50 of rectangle-shaped covers the insulative housing 20 in a direction of the front face 21 of the insulatiave housing 20. The shielding 50 has a plurality of latch portions 51 located at opposite ends thereof, wherein a latch element 52 is formed on each latch portion 51 and extends toward the latch portions 51 for being inserted through the slots 24 and the holes 412.

Figure 4:
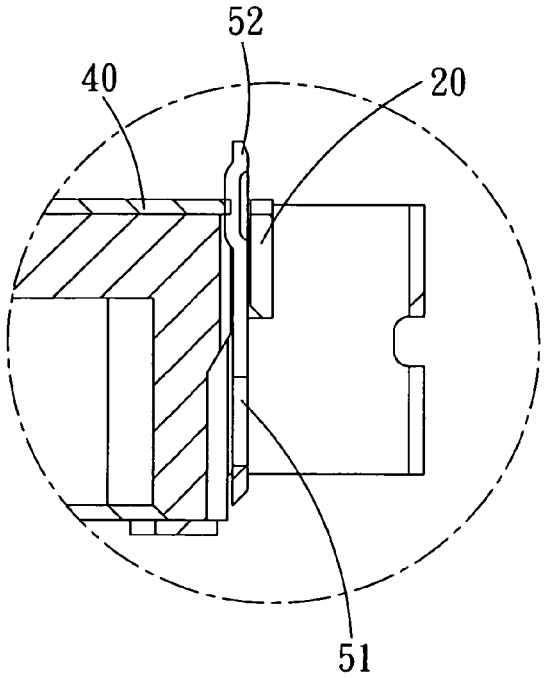
FIG. 4 is a partial and enlarged cross-sectional view showing an assembled connection between a latch element and a holding member illustrated in FIG. 2.
Figure 5:
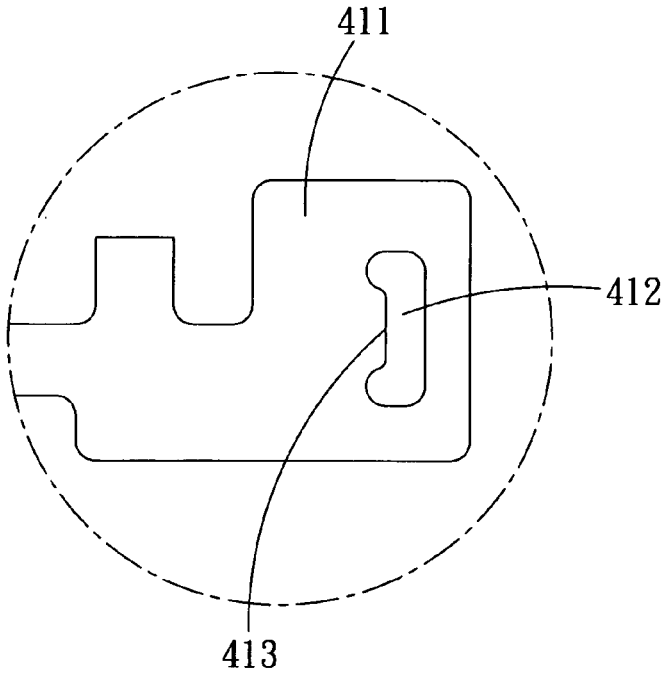
FIG. 5 is an enlarged rear view showing a part of the holding member illustrated in FIG. 3.
Figure 6:
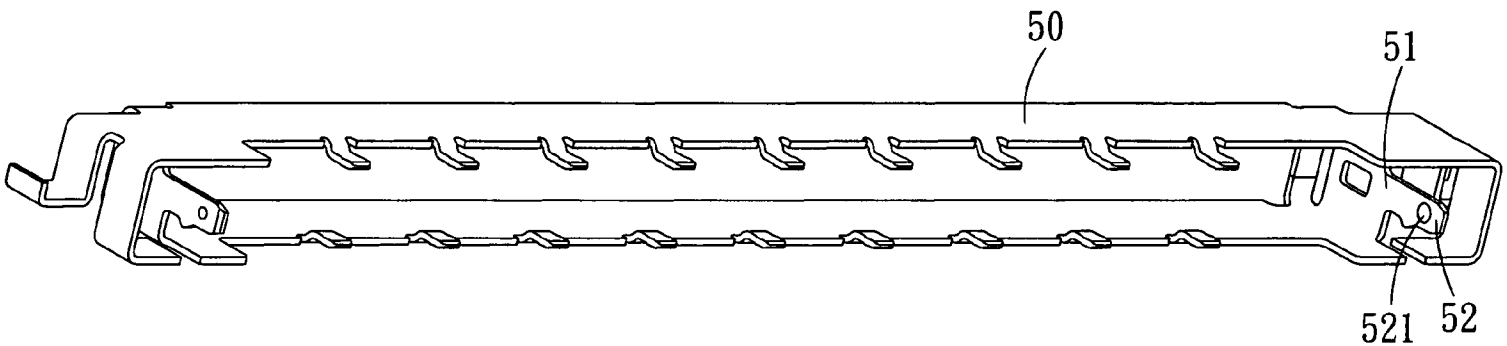
FIG. 6 is a rear perspective view of a shielding of FIG. 2.

Further referring to FIG. 4, an enlarged cross-sectional view showing an assembled connection between the latch element 52 and the holding member 40, the latch element 52 is inserted through the slots 24 and the holes 412 and interferentially engaging with the holding member 40. Moreover, a protrusion 413 is disposed on a lateral side of each hole 412 as shown in FIG. 5 and protrudes inside the hole 412 to form arcuated shape at opposite ends of the hole 412 for facilitating insertion of the latch element 52.

Figure 7:
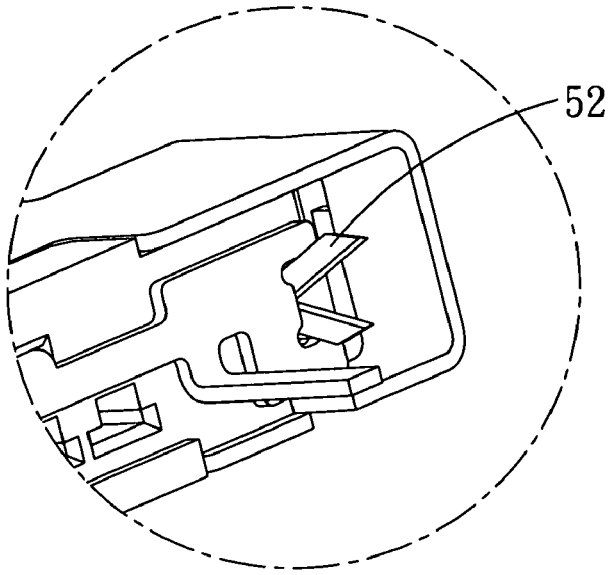
FIG. 7 is a partial and enlarged view showing another assembled connection between the latch element and the holding member.
Figure 8:
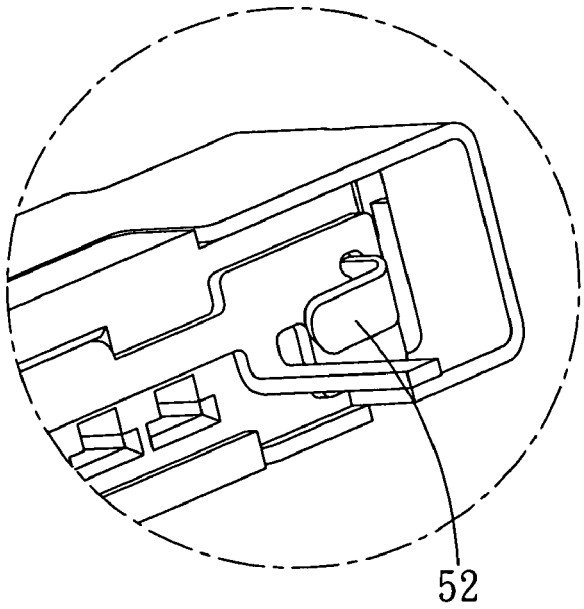
FIG. 8, is a partial and enlarged view showing still another assembled connection between the latch element and the holding member.

In comparison with conventional connector, the electrical connector 20 as described above has more simple structure and fewer components because the electrical connector 20 of the present invention does not have the grounding terminal 112 and the gape 121, and the electrical connector 20 with improved structure can be assembled easily and firmly through an engagement between the latch element 52 and the extending portion 411. Furthermore, the engagement can be enhanced, for example, by adding a hump 521 to the latch element 52 on one side thereof opposite to the protrusion 413 of the hole 412. When the latch element 52 is inserted in the hole 412, the hump 521 engages with the protrusion 413. Another example is to form the latch element 52 to be of fork-shaped as shown in FIG. 7; when the fork-shaped latch element 52 is inserted in the hole 412, bend the fork-shaped part of the latch element 52 to engage with the hole 412; or still another example as shown in FIG. 8, when the latch element 52 is inserted in the hole 412, simply bend inwardly exposed parts of the latch element 52 to engage with the hole 412.

Figure 9:
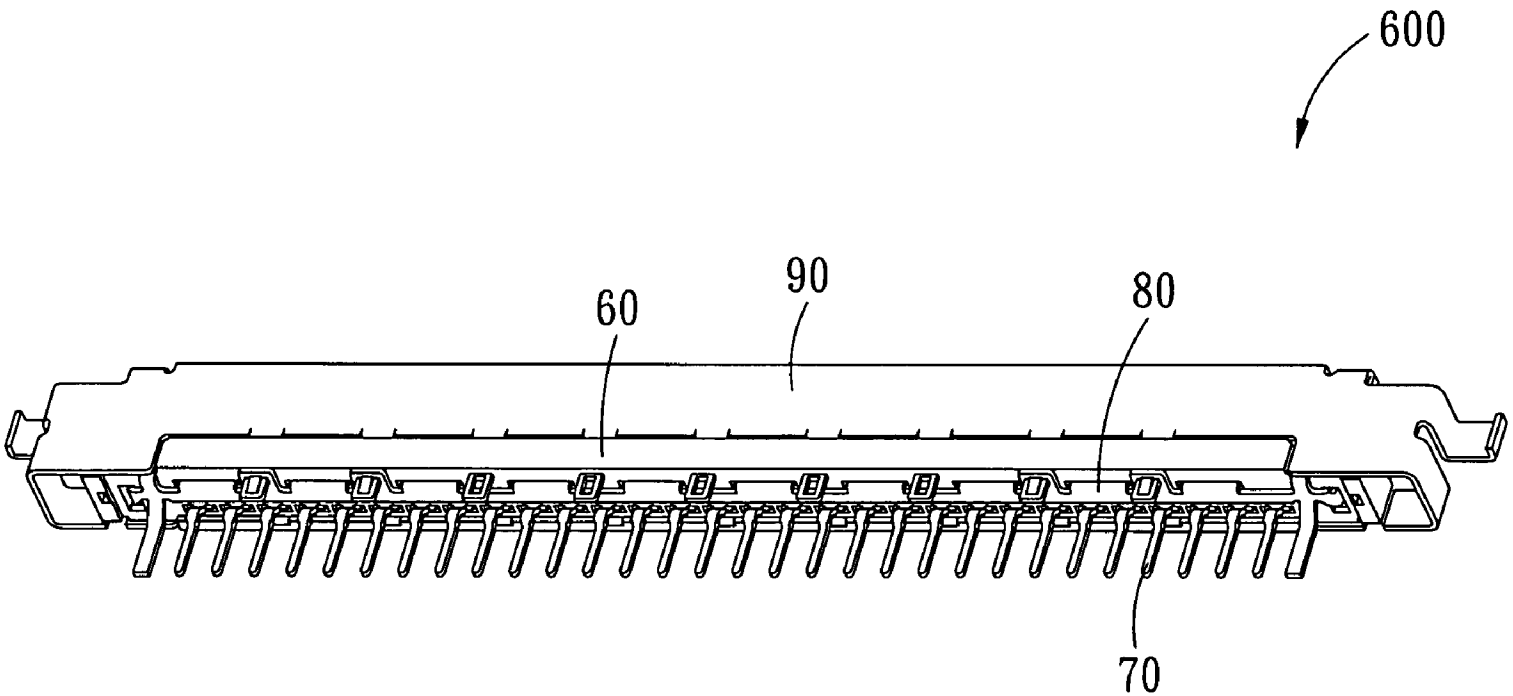
FIG. 9 is a rear perspective view of the electrical connector according to the second embodiment of the present invention.
Figure 10:
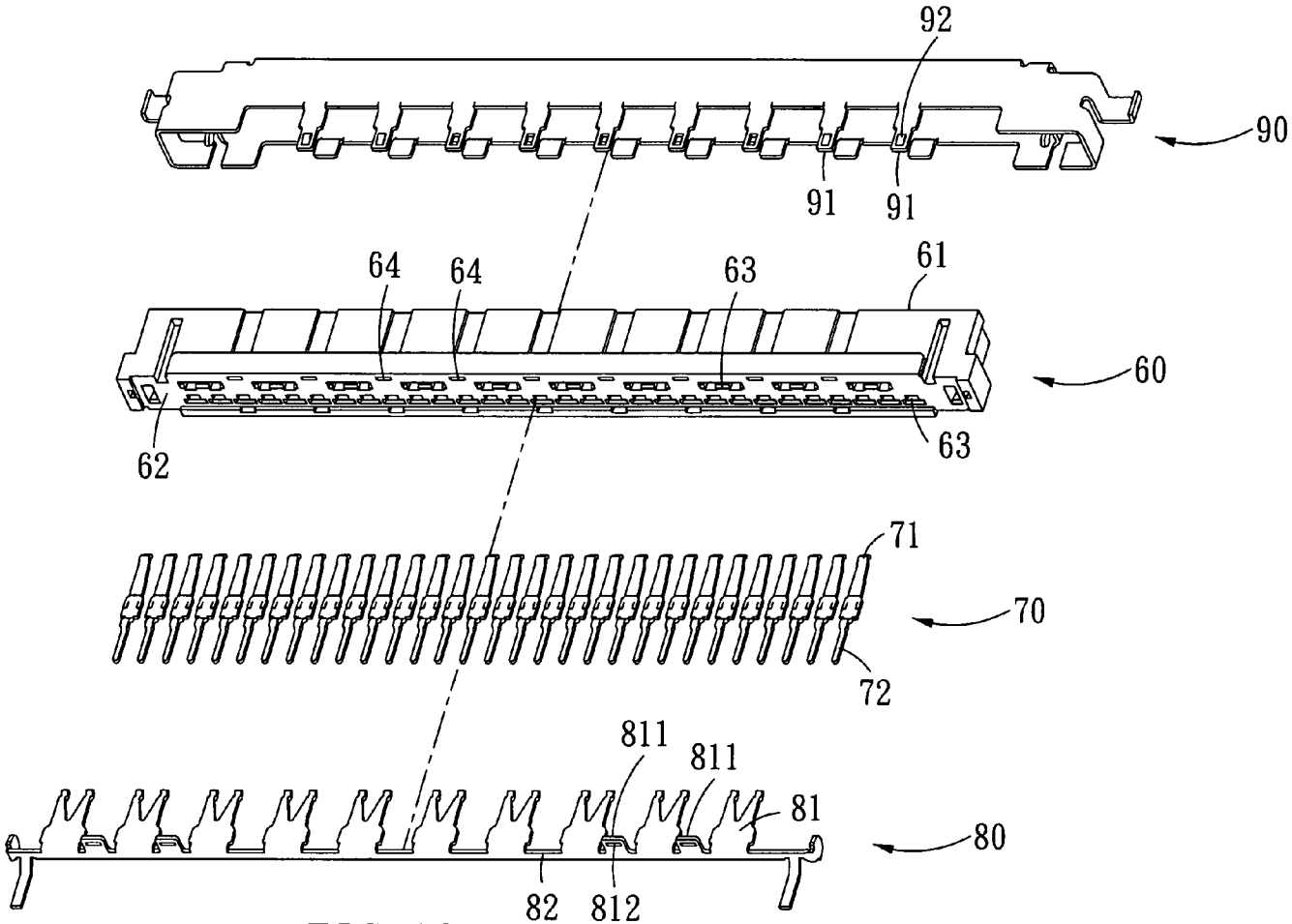
FIG. 10 is an exploded view of FIG. 9.

Referring to FIGS. 9 and 10, an electrical connector 600 in accordance with the second embodiment of the present invention includes an insulative housing 60, a plurality of terminals 70, a holding member 80 and a shielding 90. The insulative housing 60 of rectangle shape has a front face 61 for mating with a mating connector (not shown) and a rear face 62, wherein the rear face 62 has a plurality of terminal passageways 63 and a plurality of slots 64, the slots 64 disposed through the insulative housing 60 from the rear face 62 to the front face 61 and evenly spaced away from each other.

The plurality of terminals 70 are received in the terminal passageways 63, each terminal 70 having a contact part 71 and a soldering part 72, wherein the contact part 71 extends forward toward the front face 61, and the soldering part 72 extends out of the insulative housing 60. The holding member 80 includes a plurality of resilient plates 81, a coupling portion 82 for coupling the resilient plates 81, and at least an extending portions 811 extending upwardly from the coupling portion 82 and having a hole 812 thereon. The resilient plates 81 are respectively inserted into the terminal passageways 63 of the insulative housing 60, and therefore the coupling portion 82 and the extending portion 811 completely adhere to the rear face 62 and the holes 812 are in alignment with the slots 64.

The shielding 90 of rectangle-shaped covers the insulative housing 60 in a direction of the front face 61 of the insulatiave housing 60. The shielding 90 has a plurality of latch elements 91 laterally extending from a side thereof opposite to the front face 61. In assembly, the latch elements 91 are inserted through the slots 64 of the insulative housing 60 and then further through the holes 812 of the holding member 80. The latch elements 91 have barbs 92 for engaging with the holes 812 after insertion of the elements 91.

Figure 11:
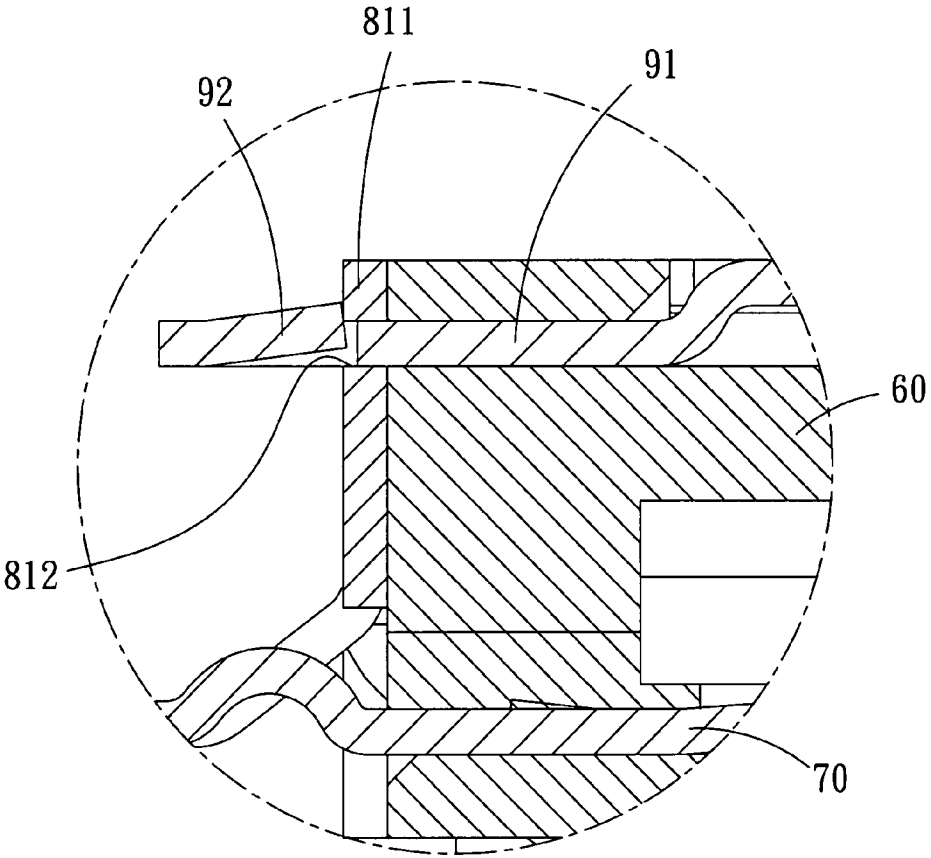
FIG. 11 is an enlarged cross-sectional view showing an assembled connection between a latch element and a holding member illustrated in FIG. 9.

The number of the barbs 92 can be determined upon practical needs. In the second embodiment of the present invention, the latch elements 91 have four barbs 92. Further referring to FIG. 11, an enlarged cross-sectional view showing an assembled connection between the latch elements 91 and the extending portion 811 of the holding member 80, wherein the barbs 92 inserted through the hole 812 and engages with the extending portion 811 whereby to form a secure engagement.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An electrical connector, comprising:

an insulative housing including a front face and a rear face, the rear face having at least a slot extending inwardly and through therefrom, said insulative housing having a plurality of terminal passageways extending therethrough;

a shielding covering the insulative housing and having at least a latch portion therein corresponding to the slot;

a plurality of terminals received in a portion of said terminal passageways of said insulative housing, each terminal having a contact part and a soldering part; and a holding member including at least a coupling portion, an extending portion and a plurality of resilient plates, said plurality of resilient plates being received in a portion of said terminal passageways, wherein, in assembly, the holding member is inserted into the insulative housing in a direction of the rear face of the insulative housing and therefore the extending portion adheres to the rear face, then the shielding covers the insulative housing in a direction of the front face of the insulative housing and therefore the latch portion inserted through the slot and contacting the extending portion of the holding member.

2. The electrical connector as claimed in claim 1, wherein the extending portion of the holding member comprises a hole, and the latch portion of the shielding further having a latch element being interferentially engagable with the hole after insertion through the slot of the insulative housing.

3. The electrical connector as claimed in claim 1, wherein the extending portion is formed at one end of the coupling portion and extends outwardly therefrom, the extending portion adhering to the rear face of the insulative housing after assembly.

4. The electrical connector as claimed in claim 1, wherein the latch element is disposed at one end of the shielding and perpendicular to the holding member.

5. The electrical connector as claimed in claim 4, wherein the latch element corresponds to the extending portion.

* * * * *